United States Patent [19]

Komatsu et al.

[11] 4,349,899

[45] Sep. 14, 1982

[54] MUSIC BOX HAVING TIME-SOUNDING FUNCTION

[75] Inventors: Fumito Komatsu, Shiojiri; Junichiro Shinozaki, Chino, both of Japan

[73] Assignee: Kabushiki Kaisha Sankyo Seiki Seisakusho, Suwa, Japan

[21] Appl. No.: 112,268

[22] Filed: Jan. 15, 1980

[30] Foreign Application Priority Data

Jan. 17, 1979 [JP] Japan ..... 54-4837[U]

[51] Int. Cl.[3] ..... G04B 21/02; G10F 1/06

[52] U.S. Cl. ..... 368/75; 368/273; 84/95 R

[58] Field of Search ..... 368/75, 272–273; 84/94–96, 106, 111, 402–404

[56] References Cited

U.S. PATENT DOCUMENTS

| | | | |
|---|---|---|---|
| 1,398,972 | 12/1921 | Little | 368/75 |
| 2,665,544 | 1/1954 | Rowe et al. | 368/75 |
| 2,812,680 | 11/1957 | Fedoryszyn | 84/102 |

*Primary Examiner*—Vit W. Miska

*Attorney, Agent, or Firm*—James C. Wray

[57] ABSTRACT

A music box having time-sounding function characterized in that a chime-zone with a row of chiming pins and a time-sounding zone with a row of time-sounding pins are formed on the periphery of a single rotatable drum in its rotating direction, said rows of pins successively fillipping vibrating teeth and thereby playing a chime, followed by time-sounding for a given hour. The number of hours to be struck is automatically selected by a sort of control cam installed parallel to said rotatable drum. The invented device, when coupled with a clock, can for instance chime and then strike once at "one o'clock" or strike two times at "two o'clock".

6 Claims, 19 Drawing Figures

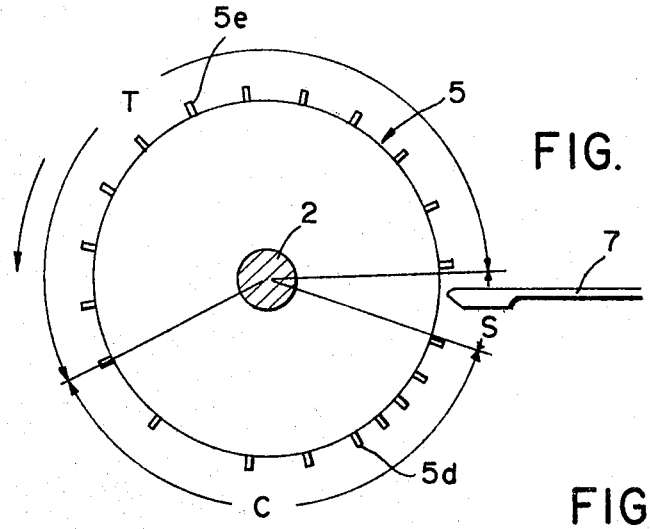
FIG. 3
FIG. 5
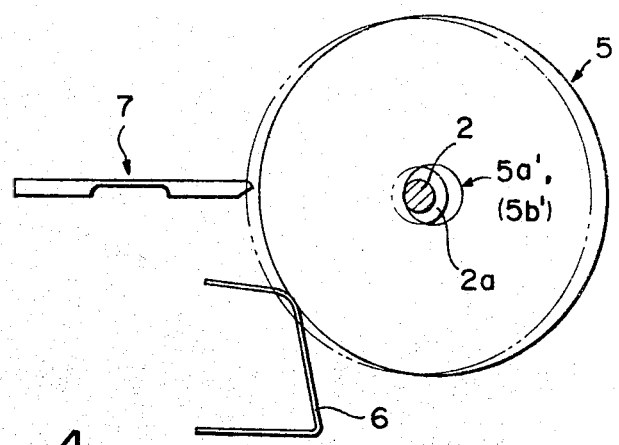
FIG. 4
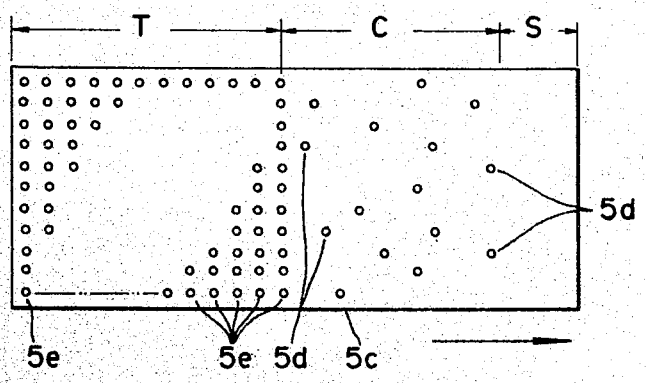

MUSIC BOX HAVING TIME-SOUNDING FUNCTION

BACKGROUND OF THE INVENTION

A type of clockwork is known which plays a short music, i.e., chimes and then strikes the hour.

The present invention is characterized in that a music box drum is equipped with chiming pins and time-sounding pins; chiming and time-sounding are done using common vibration pieces; and the music box itself serves as a clockwork which strikes once, twice and so on as time passes one hour, two hours and so on.

BRIEF SUMMARY OF THE INVENTION

Objects of the Invention

The primary object of the present invention is to provide a music box having time-sounding function which is small and light and can be very easily interlocked with a clockwork.

Another object of the present invention is to provide a music box having time-sounding function which combines the functions of music playing and time-sounding.

Still another object of the present invention is to provide a music box having time-sounding function which, started by a trigger signal issued when a given hour comes, chimes and then strikes just as many times as the given hour.

Still another object of the present invention is to provide a music box having time-sounding function which can play various chimes.

Still another object of the present invention is to provide a music box having time-sounding function whose chiming pins are variable in position so that different and various striking tones can be issued.

Other and further objects, features and advantages of the invention will appear more fully from the following description.

Description of the Drawings

FIG. 3 is a side view of the rotatable drum illustrating the positional relation of said drum to the vibration teeth.

FIG. 4 is an evolved view of the periphery of the rotatable drum.

FIG. 5 is a side view of the rotatable drum illustrating the positional relation of said drum to a leaf spring.

DETAILS OF THE INVENTION

Figure 1:
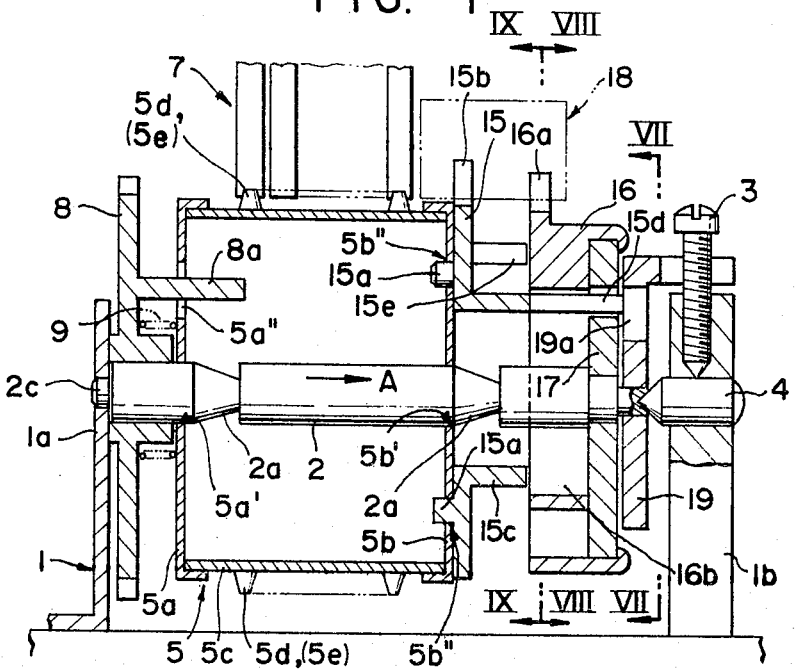
FIG. 1 is a sectional view of a device according to the present invention in a working state.

The frame 1 is fitted with a shaft 2, the middle portions of which are tapered, i.e., tapered portions 2*a*, 2*a*. One end 2*c* of said shaft 2 fits into one vertical shaft 1*a* of the flame 1, while the other end of it is supported on a support member 4 fixed by a screw 3 to the other vertical plate 1*b* of the frame 1. Both the tapered portions 2*a*, 2*a* have their narrow portions formed in the direction of the support member 4.

The rotatable drum 5 consists of two end plates 5*a*, 5*b* opposed to each other with a constant space and an annular plate 5*c* positioned between said two end plates 5*a*, 5*b*. The end plate 5*a* is provided with a shaft-running hole 5*a'*, while the end plate 5*b* is provided with a shaft-running hole 5*b'*. The end plate 5*a* has a long slot 5*a''* of radius direction formed thereon, while the end plate 5*b* has holes 5*b''*, 5*b''*, 5*b''* radially formed thereon. Meanwhile the annular plate 5*c* has a chime-zone C, a time-sounding zone T and a blank zone S formed thereon (see FIG. 4). The chime-zone C has chiming pins 5*d*, 5*d* . . . 5*d* for sounding given chimes, which jut therefrom, while the time-reporting zone T has time-sounding pins 5*a*, 5*e* . . . 5*e* jutting therefrom at equal intervals.

The rotatable drum 5 is rotatably mounted on the shaft 2 which runs through the holes 5*a'*, 5*b'*, and it is all the time urged in opposite direction to the vibration teeth 7 by means of a leaf spring 6 bearing against the fringe of the end plates 5*a*, 5*b*.

Figure 2:
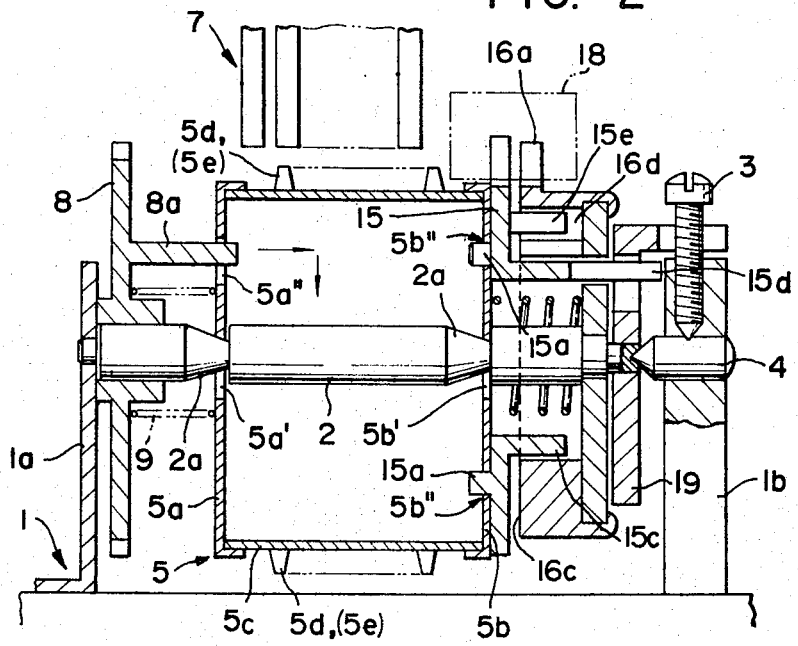
FIG. 2 is a sectional view of a device according to the present invention in a non-working state.

Therefore when the rotatable drum 5 moves in the direction A in FIG. 1 and slides along the tapered portions 2*a*, 2*a* as in the state of FIG. 2, the rotatable drum 5 is displaced in opposite direction to the vibration teeth 7 by the leaf spring 6, whereby the pins 5*d*, . . . , 5*e*, . . . formed on the drum 5 cannot fillip the vibration teeth 7.

The drive gear 8 is rotatably held on the shaft 2, the stem 8*a* of said gear 8 going into the slot 5*a''* of the drum 5. Between the drum 5 and the drive gear 8 comes a compressive coil spring 9. The drive gear 8 serves to transmit the torque of the motor 10 to the drum 5.

Figure 6:
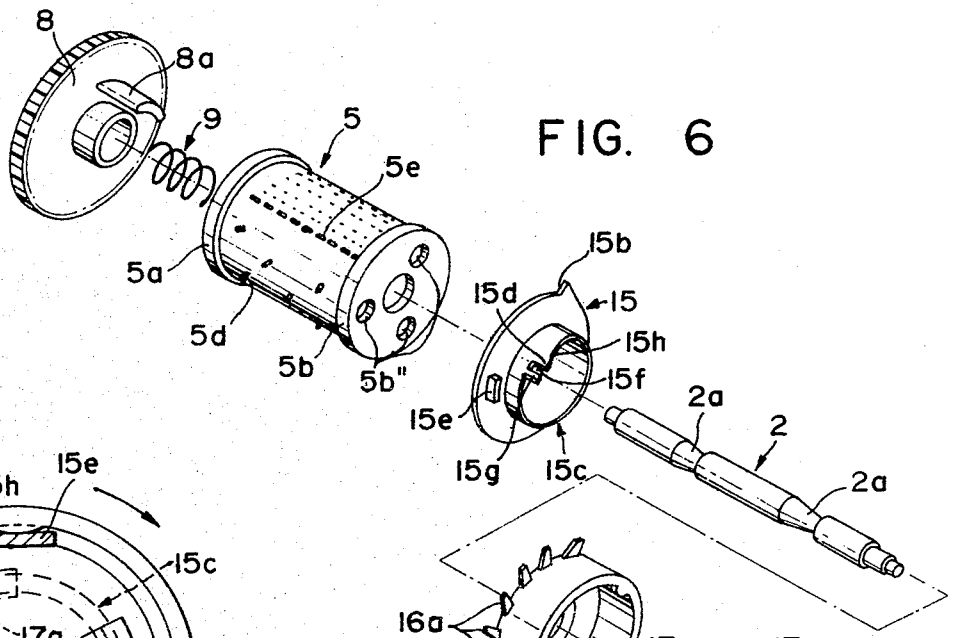
FIG. 6 is a cutaway oblique view of the device according to the present invention illustrating its principal parts.
Figure 7:
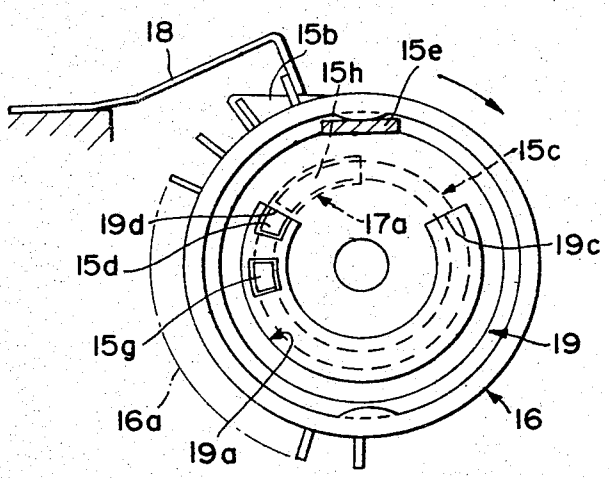
FIG. 7 is a sectional view in VII—VII direction of FIG. 1.
Figure 9:
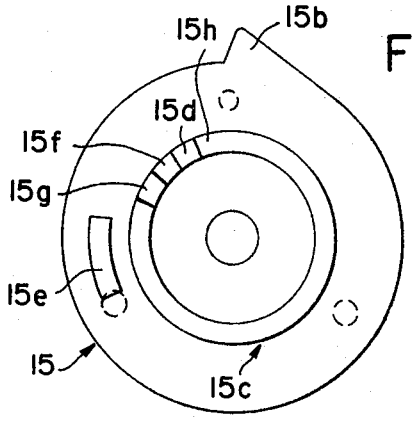
FIG. 9 is a sectional view in IX—IX direction of FIG. 1.

The end plate 5*b* of the drum 5 is attached with the first control wheel 15 of which the bosses 15*a*, 15*a*, 15*a* fit into the holes 5*b''*, 5*b''*, 5*b''*. As indicated in FIGS. 6 and 7, the first control wheel 15 is designed to have a cam piece 15*b* for removing the lever with an inclination in the leading direction of rotation at one point on the periphery; an annular bank 15*c* formed concentrically with the drum 5 at one side of the wheel 15; the first leg 15*d* formed at the end of said annular bank 15*c*; the second leg 15*e* formed a little behind the first leg 15*d* and outside of the first leg 15*d*; and a connecting projection 15*g* installed adjacent to the first leg 15*d* by providing a narrow axial recess 15*f* therebetween.

Next to the first control wheel 15 comes the second control wheel 16 for controlling the strike of time which is equipped on the periphery with 12 nail pieces 16*a*, 16*a* . . . slightly lower than the cam piece 15*b*. The second control wheel 16 has centrally a tubular recess 16*b* which permits entry of the annular bank 15*c* of the first control wheel 15.

Further, the second control wheel 16 is so fitted that it can frictionally rotate itself around the torque-transmitting plate 17 which loosely goes into the shaft 2. On the surface of said torque-transmitting plate 17 which faces the recess 16*b* there are two windows 17*a*, 17*b* adjacent to each other; and into these two windows 17*a*, 17*b* go the first leg 15*d* and the connecting projection 15*g* of the first control wheel 15 so that the connection 17*c* between said windows 17*a*, 17*b* is held in the recess 15*f*. Thus the first control wheel 15 and the second control wheel 16 are linked together so that, even when the first control wheel 15 moves together with the drum 5, the first leg 15*d* and the connecting projection 15*g* may not slip out of the windows 17*a*, 17*b*.

Said nail piece 16*a* and the cam piece 15*b* of the first control wheel 15 are jointly engaged by an elastic engage lever 18 which is wide enough to cover said nail piece 16*a*, said cam piece 15*b* and one end plate 5*b* of the drum 5. Said engage lever 18 is anchored to the frame 1 at its base end.

On the side of the second control wheel 16 opposed to the first control wheel 15 there are installed on the same circle at a specific rotating angle a high plane 16*c* and an escape groove 16*d* which constitutes a plane for setting the number of striking hour on the moving orbit of the second leg 15*e* so as to make the second leg 15*e* insert into the high plane 16*c* and remove from the groove 16*d*. Said high plane 16*c* contains a range for setting the number of striking hour T' approximately matching the rotating angle of the time-sounding zone T; and said groove 16*d* is formed within ranges containing the chiming zone C and the blank zone S (FIGS. 11*a–h*).

The rear end of said high plane 16*c* and the front end of said groove 16*d* are connected over a ramp 16*e* which assures smooth movement of the second leg 15*e*.

Farther next to the second control wheel 16 comes a complex action plate 19 fixed to the frame 1 by the shaft 2. The complex action plate 19 is formed by an arc hole 19*a* to permit projection of the first leg 15*d* onto the moving orbit of the first leg 15*d* and a blind plate 19*b* to let said leg 15*d* escape toward the drum side of said action plate 19, on the same circle. Said blind plate 19*b* is set at a rotating angle covering the pitches of the chiming zone C and the time-sounding zone T.

Figure 12:
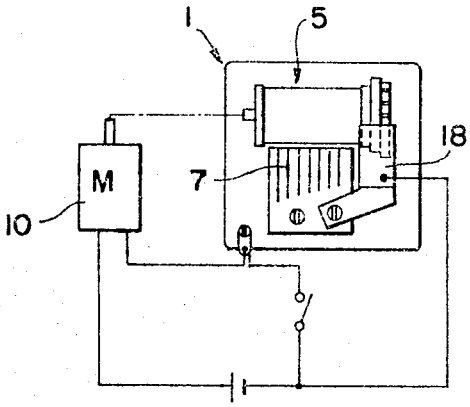
Figure 8:
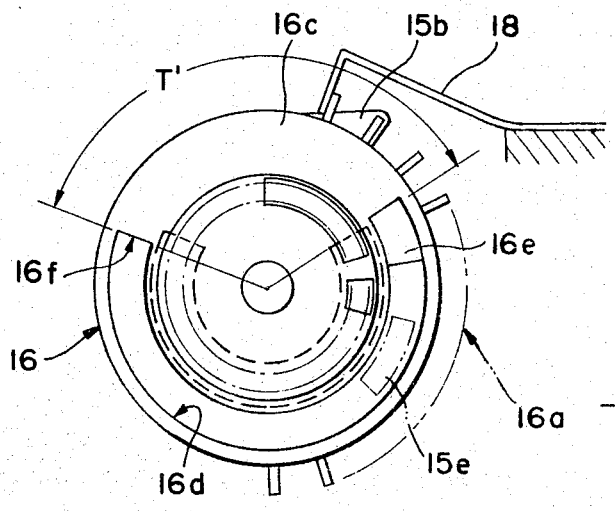
FIG. 8 is a sectional view in VIII—VIII direction of FIG. 1.
Figure 10:
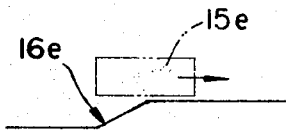
FIG. 10 is a sectional view illustrating the engagement of the second leg of the first control wheel with a slope of the groove in the second control wheel.

The drive gear 8 is connected to a motor 10 as shown in FIG. 12. The plus terminal of said motor is connected to the power source (E), while the minus terminal of it is connected to the frame 1, finally leading to the negative side of the power source over the rotating shaft 2, the end plates 5*a*, 5*b* (metal plates) and the engage lever 18.

To the frame 1 and the negative side of the source is connected a switch S which momentarily closes when the clock points to an hour.

The performance of the device is to be described in the following.

In the non-working state, the engage lever 18 is slightly lifted by the cam piece 15*b* of the first control wheel 15, which means that, said lever 18 being out of contact with the end plate 5*b*, the motor circuit is open and accordingly the drum 5 stays at rest.

Meanwhile the first leg 15*d* of the first control wheel 15 has its ramp 15*h* located slightly away from the arc hole 19*a* of the action plate 19, being pressed toward the drum-side of the blind plate 19*b*; and accordingly the drum 5 overcoming the force of the spring 9 is back to the thick positions except the tapered positions 2*a*, 2*a* of the shaft 2 in FIG. 1, i.e., to a position where said drum 5 can fillip the vibration teeth 7. On the other hand, the front end of the chiming pin 5*d* is located opposite to the vibration pieces 7 as indicated in FIG. 3.

Now the operation to strike, for example, two o'clock is to be described. For this purpose, as illustrated in FIG. 7, the engage lever 18 engages the nail piece 16*a* in the foremost row of the second control wheel 16, thereby inhibiting the rotation of the second control wheel 16.

Just as the clockwork points to two o'clock, the switch S instantly closes to start the motor 10, which drives successively the drum 5, the first control wheel 15 fitted to the drum 5 and the torque-transmitting plate 17 connected via the first leg 15*d* to the first control wheel 15. Thereupon the cam piece 15*b* of the first control wheel 15 pushes up the lever 18, thereby the second control wheel 16 begins to turn. Moreover, since said lever 18 reverts to the original position after passage of said cam piece 15*b*, the lever 18 comes to engage a second nail piece 16*a*. Thus the second control wheel 16 can move one pitch only. In other words, as seen from FIG. 11*a* (which indicates the instant of two o'clock being struck), the front end of the high plane 16*c* constituting the plate for setting the number of striking hour of the second control wheel 16 is staggered in the rotating direction from the rear end of the blind plate 19*b* of the complex action plate 19 by an angle $\alpha$ which is equivalent to said one pitch.

Now description is to be made from the start position. First, the first leg 15*d* of the first control wheel 15, which starts to rotates integrally with the drum 5, comes to slide against the inside surface of the blind plate 19*b* of the complex action plate 19 from its forward side in clockwise direction of FIG. 7. Thereby the whole chiming zone C and the foremost row of pins in the succeeding time-sounding zone T come to be fillipped by the vibration teeth. Immediately after the foremost row of pins are fillipped, the first leg 15*d* is about to move from the rear end of the blind plate 19*b* and go into the arc hole 19*a*, but the second leg 15*e* is still on the high plane 16*c* of the second control wheel 16. Therefore, the drum 5 without dropping into the recess 2*a*, 2*a* can continue to rotate and in consequence as the second leg 15*d* reaches the high plane 16*c* within the angle $\alpha$ indicated in FIG. 11*a*, the second row of pins can be fillipped, namely two o'clock can be struck.

Figure 11A:
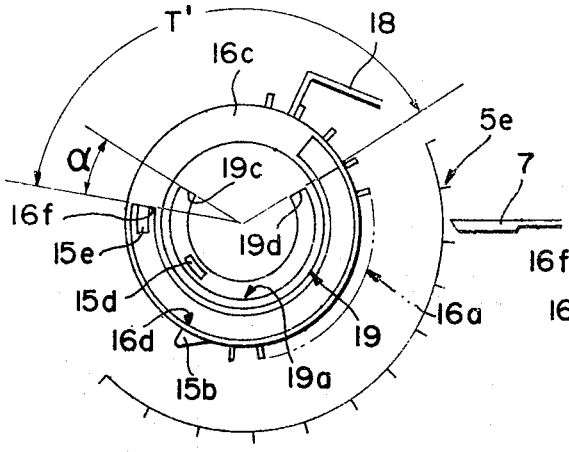
FIGS. 11*a–h* are diagrams illustrating the working state of the control cam installed parallel to the rotatable drum.

Immediately thereafter, the second leg 15*d* projects into the recess 16*d* from the front end 16*f* of said high plane 16*c*, as shown in FIG. 11*a* and thereby the first leg 15*d* too projects into the arc hole 16*d* and accordingly the drum 5 drops into the tapered portions 2*a*, 2*a* of the shaft 2. Thus the drum 5 is separated from the vibration teeth 7, as indicated in FIG. 2. Thus separated, the drum 5 continues to move from the position shown in FIG. 11*a*. With this movement of the drum 5, the first leg 15*d* moves up to the position shown in FIG. 11*b* where it reaches the front end 19*d* of the blind plate 19*b* of the complex action plate 19 and slightly ducks under the front end 19*d* of the blind plate 19*b*. This ducking causes the drum 5 at the tapered portions 2*a*, 2*a* to be pushed back and at the same time an on coming cam piece 15*b* pushes up the engage lever 18, thereby detaching the lever 18 from the end plate 5*b*, opening the motor circuit and halting the drum 5.

Figure 11B:
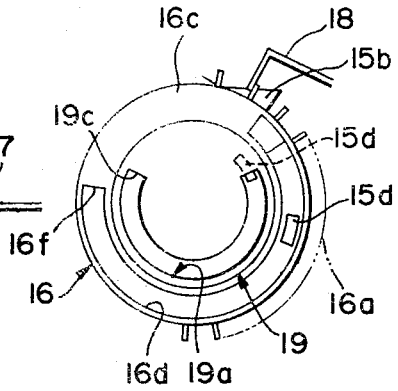
Figure 11C:
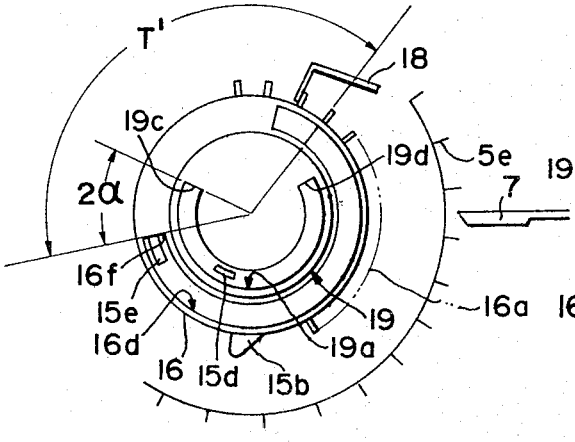

FIG. 11*c* illustrates the state just after three o'clock has been struck, i.e., just after the time-sounding pins in the third row from the front have been struck. The process up to this state is the same as the process of striking two o'clock.

For the purpose of striking three o'clock the engage lever 18 has to engage the nail piece 16*a* next to the one 16*a* for striking two o'clock. It follows therefrom that the angle $\alpha$ is one pitch advanced from the angle shown in FIG. 11*a*, i.e., twice rotating angle.

Figure 11D:
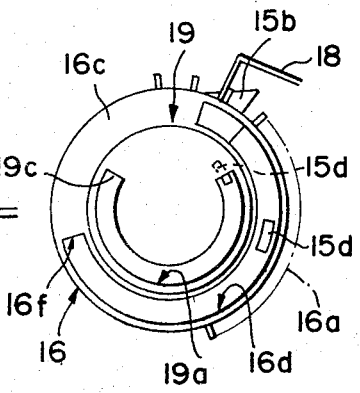

FIG. 11*d* is a diagram corresponding to the above (FIG. 11*b* where the first leg 15*d* continues to move from the state shwon in FIG. 11*c* and ducks under the front end 19*d* of the blind plate 19*b*, thereby causing the drum to halt.

Figure 11E:
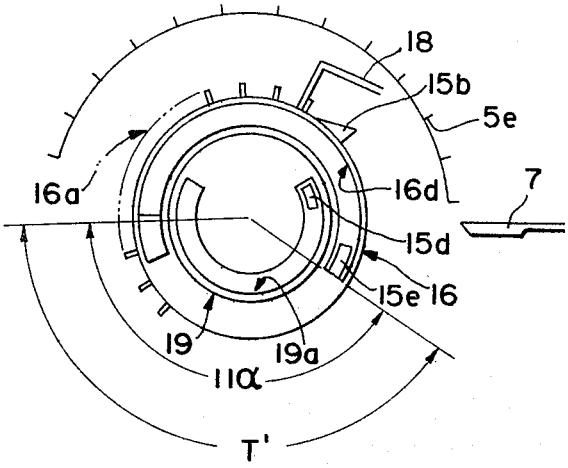

FIG. 11*e* represents the state just after twelve o'clock has been struck, or just after all the pins up to the 12th row have been fillipped, whereby the angle $\alpha$ is wide enough to cover 12 rows.

Figure 11F:
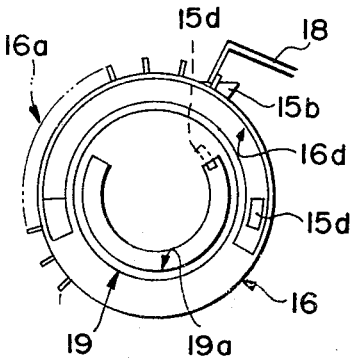

FIG. 11*f* is a diagram corresponding to FIG. 11*b*, FIG. 11*d* above, at which the first leg 15*d* continues to move from the states shown in FIG. 11*e* and returns to the front end 19*d* of the blind plate 19*b*, thereby bringing the drum to a halt.

Figure 11G:
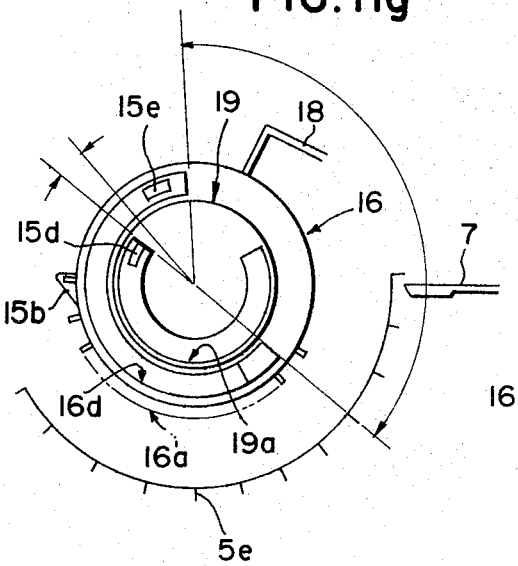

FIG. 11*g* represents the state just after the drum has moved from the state shown in FIG. 11*f* and struck one o'clock. At the position shown in FIG. 11*f* the lever 18 is engaged by the nail piece 16*a* of the rearmost row. Therefore, when the drum starts and the cam piece 15*a* disengages said lever 18, the second control wheel 16 will continue to turn over a wide range until the nail piece 16*a* of the foremost row comes round to the lever position, because no pin 16*a* immediately follows the lever 18. Anyway, the blind plate 19*b* of the complex action plate 19 has a rotating angle to cover one pitch each of the chiming zone C and the time-sounding zone T. Therefore one hour will be struck while the first leg 15*d* ducks under the front end 19*d* of the blind plate 19*b* and emerges again from under the rear end 19C; in other words, the hour is struck just before said leg emerges again and accordingly the angle $\alpha$ at the blind plate 19*b* is just one pitch wide. Thus when one o'clock is struck, the high plane 16*c* constituted by the range T' for setting the number of striking hour of the second control wheel 16 is not used.

Figure 11H:
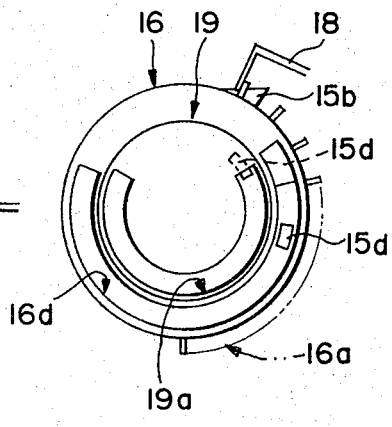

FIG. 11*h* is a diagram for FIG. 11*g* at which immediately after striking of one o'clock a continued rotation of the drum causes the first leg 15*d* to duck under the front end 19*d* of the blind plate 19*b*, thereby stopping the drum 5 just as in the above.

Thus the present invention, according to which a music box drum is equipped with chiming pins and time-sounding pins, making it possible to use the vibration teeth jointly for chiming and for time-sounding, and the music box itself serves as a chiming clock, has an extremely remarkable feature.

We claim:

1. Music box having time-sounding function comprising:

a rotatabe drum equipped with chiming pins at the side of its leading direction of rotation and time-sounding pins successively in the rotating direction;

a means to drive said drum;

a vibration tooth to engage the pins as the drum moves;

a means to control the forward and backward movement of said drum to the vibration tooth;

and a means to permit the drum to delay one pitch as the time-sounding pin is engaged and to forcibly push the drum forward as the chiming pin is engaged.

2. Music box having time-sounding function of claim 1, wherein a shaft to thrustably support the drum is provided with tapered portions; the drum is spring-urged toward the small diameter sides of the tapered portions; and the drum is spring-urged in opposite direction to the vibration tooth.

3. Music box having time-sounding function of claim 1, wherein two cam pieces integrated to the drum bear against a stationary member and a movable member with arc groove; the groove in the stationary member matches the pin at least from the second row to the last one; the movable member is a ratchet wheel free to rotate and slide against the drum, the ratchet interval matching the pin row interval; the groove in the movable member matches the pin at least from the second row to the last one; and at the initial position of the ratchet the groove begins midway between the first and the second row of pins.

4. Music box having time-sounding function of claim 1, wherein the ratchet stopper serves at the same time as a contact piece; the drum and the contact piece are all the time in sliding contact; the stopper and the drum are also in sliding contact; and an insulating ratchet integrated to the drum pushes up the stopper when the drum is at original position, thereby breaking the circuit.

5. Music box having time-sounding function of claim 1, wherein a trigger signal is issued at hour position (0 o'clock, one o'clock . . . ) and thereby the drum is rotated at least enough to separate the insulating ratchet from the stopper.

6. Music box having time-sounding function of claim 1, wherein different hour-strike tones can be issued by changing the position of pins in the rows.

* * * * *